United States Patent [19]

Sato et al.

[11] 4,358,813

[45] Nov. 9, 1982

[54] IGNITION APPARATUS FOR A BURNER

[75] Inventors: Munekazu Sato, Hirakata; Muneo Nishimura, Katano; Taichi Harada, Matsuzaka, all of Japan

[73] Assignee: Matsushita Electric Industrial Co., Ltd., Osaka, Japan

[21] Appl. No.: 208,649

[22] Filed: Nov. 20, 1980

[51] Int. Cl.[3] ..... F23Q 3/00

[52] U.S. Cl. ..... 361/263; 315/209 T

[58] Field of Search ..... 361/253, 263, 256, 257; 315/209 T, 209 M; 336/170

[56] References Cited

U.S. PATENT DOCUMENTS 2,323,650 7/1943 Dawson ..... 336/170

3,910,246 10/1975 Canup ..... 315/209 T

*Primary Examiner*—C. C. Shaw

*Attorney, Agent, or Firm*—Stevens, Davis, Miller & Mosher

[57] ABSTRACT

A compact ignition apparatus for a burner, which rectifies the commercial power source and energizes a high-voltage transformer via a transistor blocking oscillator circuit, and in which the high-voltage transformer is provided with a control circuit for controlling the output of the transformer to a constant value against any fluctuation of the input to the transformer, whereby a secure ignition is provided.

8 Claims, 8 Drawing Figures

IGNITION APPARATUS FOR A BURNER

BACKGROUND OF THE INVENTION

This invention relates to an ignition apparatus which is incorporated in a burner using such fuel as oil or gas and serves to provide a stable and secure ignition of the burner.

According to empirical facts, high power electrical spark discharges are needed to provide a secure ignition of fuel in a burner, especially of fuel oil in an oil burner.

The conventional ignition apparatus of this type for a burner consists mainly of a high-voltage step-up transformer and therefore has an advantage that the spark discharge is so intense that ignition may be secured. However, the conventional apparatus also has a drawback that the size is increased which results in an increase in cost.

There is another conventional ignition apparatus which uses thyristors as switching elements. That example is shown in FIG. 1. In FIG. 1, reference numeral 1 indicates an ac power source; 2 a switch; 3 a rectifying diode; 4 a pulse transformer; 5 a commutating diode; 6 a charge/discharge capacitor; 7 a high-voltage step-up transformer; 8 a thyristor; 9 a trigger circuit for the thyristor 8, a consisting of a resistor, a zener diode and a capacitor. This ignition circuit operates as follows. When a voltage higher than a predetermined voltage is developed across the charge/discharge capacitor 6 as a result of charging, the trigger circuit 9 is actuated to turn on the thyristor 8. Accordingly, the charges stored in the charge/discharge capacitor 6 are released through the primary winding of the high-voltage step-up transformer 7 so that a high voltage is induced across the secondary winding thereof. The high voltage then causes spark discharges at the spark gap in the secondary circuit, leading to an ignition of fuel.

With this ignition apparatus, the commutation by the thyristor 8 becomes difficult for a HF current with a frequency higher than 10 KHz and therefore there is a need, in such a case, for providing this circuit with a commutating circuit and a protecting circuit. The resultant apparatus is unstable under the fluctuations of load and input. Moreover, since this circuit comprises an LC circuit consisting of the charge/discharge capacitor and the primary winding of the step-up transformer 7 and is used under a resonant condition, the thyristor 8 must be able to withstand a high voltage. This is a drawback since a thyristor having a higher withstand voltage is more expensive.

SUMMARY OF THE INVENTION

The object of this invention is to provide a small ignition apparatus for a burner, which rectifies the commercial power source and energizes a high-voltage transformer via a transistor blocking oscillator circuit, and in which the high-voltage transformer is provided with a control circuit for controlling the output of the transformer to a constant value against any fluctuation of the input to the transformer, whereby a secure ignition is obtained.

DESCRIPTION OF THE PREFERRED EMBODIMENT

Figure 2:
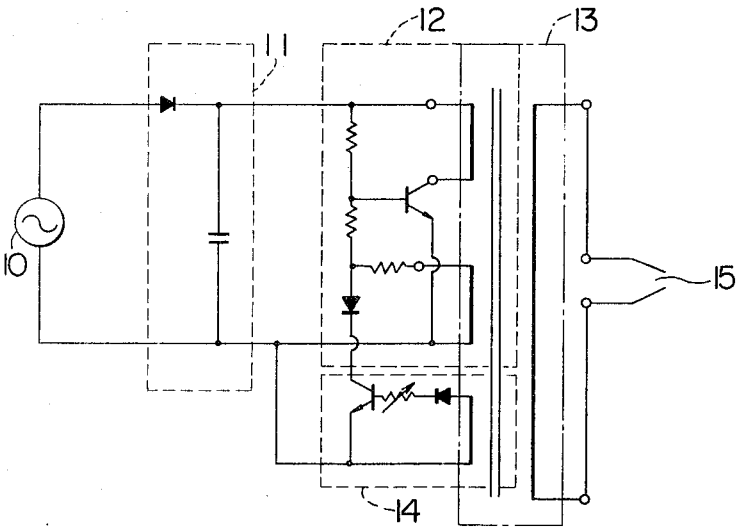

First, in FIG. 2 showing a schematic structure of an ignition circuit as an embodiment of this invention, a reference numeral 10 designates an ac power source; 11 a rectifying circuit; 12 a blocking oscillator; 13 a high-voltage transformer; 14 a control circuit; and 15 a spark gap.

Figure 3:
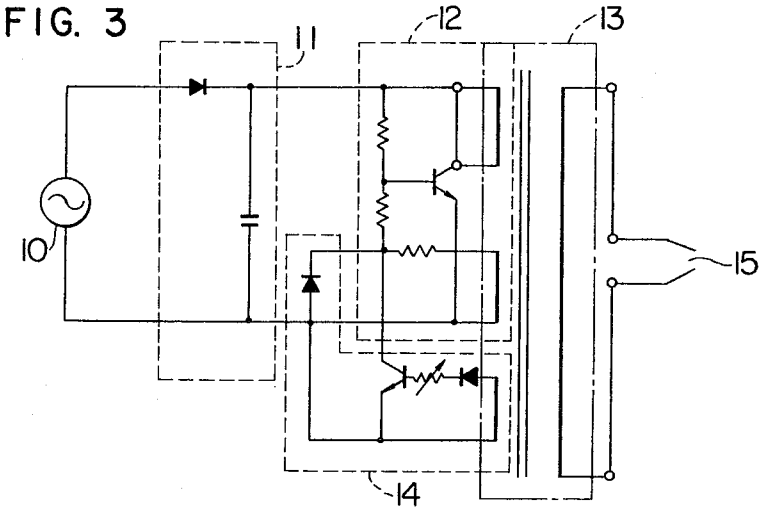
FIG. 2 to FIG. 4 schematically show electric circuits of an ignition apparatus for a burner as embodiments of this invention.

The embodiment shown in FIG. 3 is a variation of the embodiment shown in FIG. 2. It is obtained by removing the diode connected in series with the collector of a control transistor in the control circuit 14 in FIG. 2 and by connecting a protecting diode between the collector and emitter of the control transistor.

Figure 4:
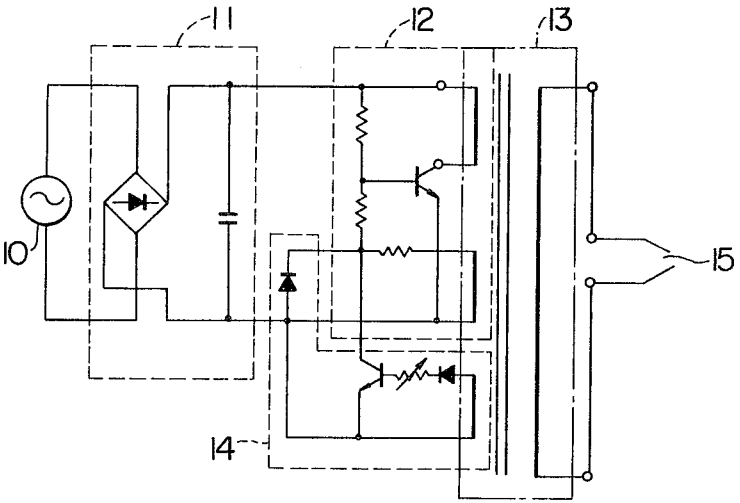
Figure 1:
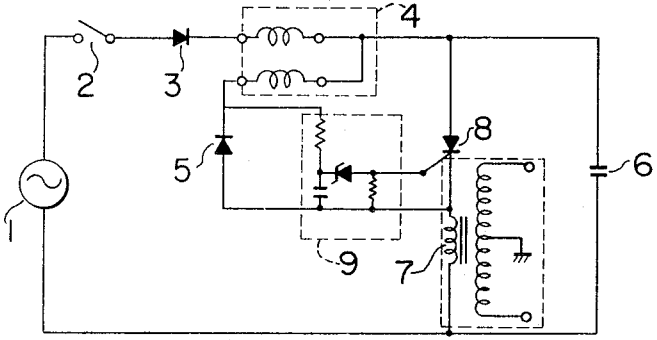
FIG. 1 (PRIOR ART)
FIG. 1 shows an electric circuit of a conventional ignition apparatus for a burner.

The embodiment shown in FIG. 4 is obtained by replacing a diode in the rectifying circuit 11 in FIG. 3 by a bridge-connected diode circuit.

Figure 5:
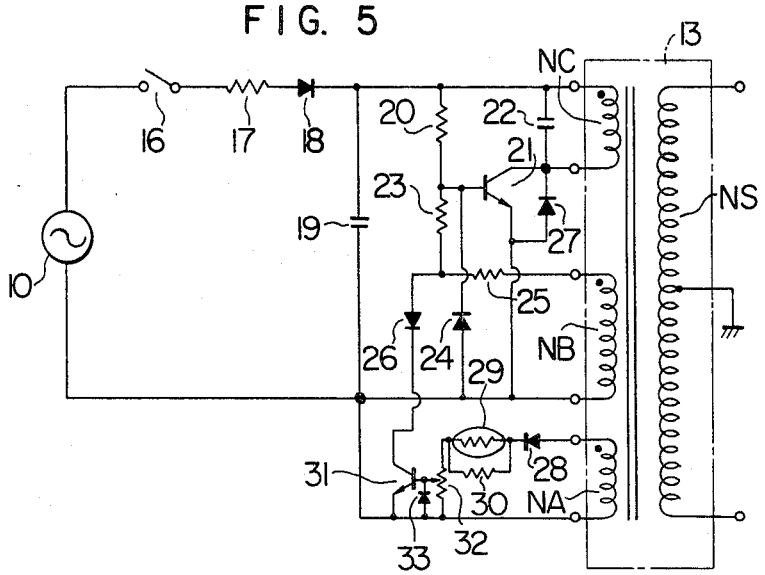
FIGS. 5 and 6 show further detailed circuits of an ignition apparatus for a burner as embodiments of this invention.

FIG. 5 shows a detailed circuit as an embodiment of this invention, based on the schematic structure shown in FIG. 2, in which the rectifying circuit 11 comprises a switch 16, a protecting resistor 17, a rectifying diode 18 and a smoothing capacitor 19. The high-voltage transformer 13 has a collector winding $N_c$, a base winding $N_B$ and a control winding $N_A$ on the primary side and an output winding $N_S$ on the secondary side.

In the blocking oscillator circuit 12, the start end of the collector winding $N_C$ and one end of a starting resistor 20 are connected with the plus(+) side conductor of the rectifying circuit 11. The finish end of the collector winding $N_C$ is connected with the collector of an oscillation transistor 21. An oscillation capacitor 22 is connected in series with the collector winding $N_C$. The other end of the starting resistor 20 and one end of a base resistor 23 are connected with the base of the oscillation transistor 21. A protecting diode 24 is connected between the base and the emitter of the oscillation transistor 21. Another base resistor 25 is connected with the start end of the base winding $N_B$ and the finish end of the base winding $N_B$ is connected with the emitter of the oscillation transistor 21. A rectifying diode 26 is connected with the junction point of the base resistors 23 and 25. A protecting diode 27 is connected between the collector and the emitter of the oscillation transistor 21.

In the control circuit 14, the start end of the control winding $N_A$ is connected through a rectifying diode 28 with a thermistor 29 and a resistor 30. A base resistor 32 for a control transistor 31 has its one end connected with the remaining ends of the thermistor 29 and the resistor 30. The other end of the base resistor 32 and the emitter of the control transistor 31 are connected in common with the finish end of the control winding $N_A$. This junction point is then connected with the emitter of the oscillation transistor 21. The collector of the control transistor 31 is connected through the rectifying diode 26 with the junction point of the base resistors 23 and 25. A protecting diode 33 is connected between the base and the emitter of the control transistor 31.

With this constitution described above, if the switch 16 is turned on, a nearly half-wave rectified dc power source is made up of the rectifying diode 18 and the smoothing capacitor 19 having a short charging time constant as compared with the blocking oscillator circuit 12.

This dc power source actuates the blocking oscillator comprising the oscillation transistor 21, the high-voltage transformer 13, the starting resistor 20 and the base resistors 23 and 25. The resulting blocking oscillation is an intermittent oscillation since the dc source has the smoothing capacitor 19 having a small time constant. As a result of this oscillation, a high voltage with a high frequency (higher than 20 KHz) is induced in and developed across the output winding $N_S$ of the high-voltage transformer 13.

Now, description will be made of the operation of the control circuit 14 to cope with the input fluctuation, the environmental fluctuation (temperature change) and the load fluctuation.

With the start of the oscillation, the control winding $N_A$ also develops a predetermined voltage output, which is rectified by the rectifying diode 28 and then applied through the thermistor 29, the resistor 30 and the base resistor 32 to the base of the control transistor 31.

First, the control operation for the input fluctuation will be described. When the ac input voltage fluctuates, the voltage at the collector of the oscillation transistor 21 also fluctuates so that the voltage induced in the control winding $N_A$ fluctuates, too. As a result of this fluctuation, the base bias for the control transistor 31 changes so that the collector current of the control transistor 31 changes to control the base current for the oscillation transistor 21. Consequently, the transistor 21 operates on a constant oscillation voltage and therefore a stable output is obtained.

Moreover, the load fluctuation (e.g. discharge, circuit opening, short-circuiting, the change in the length of the spark gap 15 etc.) changes the voltage at the collector of the oscillation transistor 21. In this case, too, the voltage developed across the control winding $N_A$ changes linearly and therefore the load fluctuation behaves just like the input fluctuation.

Next, the environmental fluctuation, i.e. temperature fluctuation, will be mentioned. The thermistor 29 inserted in the base bias circuit for the control transistor 31 increases the base current for the control transistor 31 at high temperatures and decreases the same base current at low temperatures. Thus, the base current for the oscillation transistor 21 can be controlled, and that in the same manner as in the input and the load fluctuations.

The base resistor 32 provided in the base circuit of the control transistor 31 is a partially fixed resistor or a semi-variable resistor and it serves to correct the deviations of the current amplification factor hfe of the oscillation transistor 21 or the control transistor 31 through increasing or decreasing the resistance thereof.

Figure 6:
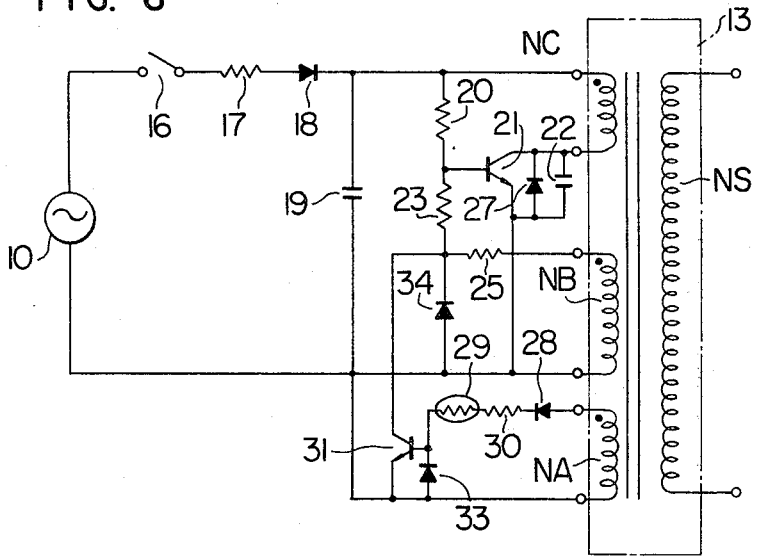

FIG. 6 shows a concrete example which may be used for other suitable purposes with other circuit ratings. This circuit can be obtained by modifying the circuit shown in FIG. 5 in the following manner.

First, the protecting diode 24 and the diode 26 are removed and intead a diode 34 is connected between the collector and the emitter of the control transistor 31. As a result of this modification, the flyback voltage across the base winding $N_B$ is so bypassed as to prevent a reverse voltage from being applied between the emitter and the base of the oscillation transitor 21 and moreover a reverse current which is hfe times the current flowing through the diode 33, the base and the collector of the control transistor 31 and which flows from the emitter to the collector of the transistor 31, can be bypassed. Thus, the diode 34 replaces the functions of the diodes 24 and 26.

Further, a resonance capacitor 22 is connected in parallel with the protecting diode 27 between the collector and the emitter of the oscillation transistor 21. Accordingly, the collector-emitter voltage $V_{CE}$ of the oscillation transistor 21 falls and on the contrary the collector current $I_C$ increases. These values can be chosen according to the ratings of the circuit in question. In this case, this means that the change in the inductance of the collector winding $N_C$ is small and that the output voltage is stabilized. Moreover, if the thermistor 29 and the fixed resistor 30 in the control circuit 14 are connected in series with each other, as shown in FIG. 6, then the thermistor 29 governs the characteristic of the overall circuit in a high temperature domain. The choice between the series and parallel connections may depend on the characteristics of the circuit elements used.

The ignition circuit shown in FIG. 6 may be further modified by replacing the diode 18 in the rectifying circuit 11 by a full-wave rectifying bridge circuit. The merit of the full-wave rectifying configuration is the capability of obtaining double the output of a half-wave rectifying circuit when the output is limited since the charging time constant of the smoothing capacitor 19 is very small as compared with the oscillation period of the blocking oscillator circuit 12. In this case, however, heat loss in the oscillation transistor 21 and the associated resistors will be multiplied.

Finally, the structure of the high-voltage transformer 13 will be more concretely described.

Figure 7:
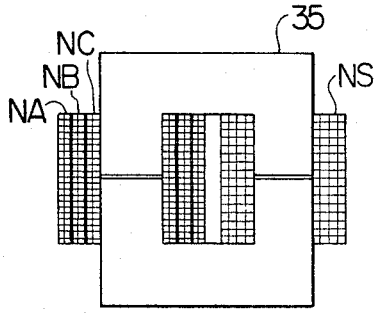
FIGS. 7 and 8 show the schematic structures of high-voltage transformers used in the embodiments of this invention.

FIG. 7 shows an embodiment in which a collector winding $N_C$, a base winding $N_B$ and a control winding $N_A$ are stacked one upon another on one leg of a rectangular magnetic core 35 consisting of two U-shaped ferrite core members and an output winding $N_S$ is provided on the other leg of the rectangular magnetic core 35.

This configuration is so adopted as to provide a close magnetic coupling whereby the voltage developed across the base winding or the control winding may vary linearly with the change in the voltage across the collector winding due to the input or load fluctuation.

Figure 8:
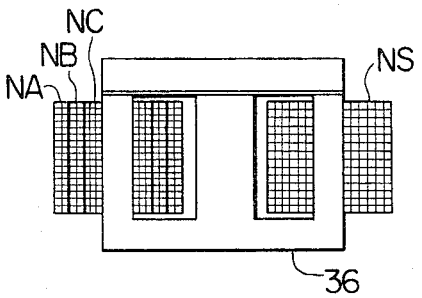

FIG. 8 shows another embodiment in which a collector winding $N_C$, a base winding $N_B$ and a control winding $N_A$ are stacked one upon another on one of the outer legs of a three-legged magnetic core 36 consisting of an E-shaped and an I-shaped core members and an output winding $N_S$ is provided on the other outer leg of the three-legged magnetic core 36. In this configuration, the middle leg serves as a magnetic shunt to enhance the above described effect of the linear response of the base or control winding voltage to the collector winding voltage.

As described above, the ignition apparatus for a burner, according to this invention can generate a high-voltage output even at a high frequency of 20 KHz and when discharge takes place, the produced sparks are high power electrical ones having sufficient energy to fire fuel cell. Moreover, the capability of using such a high frequency leads to the reduction in the size of the high voltage transformer. Accordingly, this invention has the following merits. Namely, the overall size of the ignition apparatus can be reduced, the cost can be lowered, and a secure ignition can be effected since a constant output can be delivered irrespective of the input, load and environmental fluctuations. Thus, this invention is of highly practical value in the field of the art.

We claim:

1. An ignition apparatus for a burner comprising:

a rectifying circuit connected to an ac power source;

a blocking oscillator circuit connected to receive a rectified output from said rectifying circuit, said oscillator circuit including an oscillation transistor, and a collector winding and a base winding which are provided on the primary side of a high voltage transformer; and a control circuit including a control winding provided on the primary side of said transformer, said control circuit being connected between a base and an emitter of said oscillation transistor to control a base current thereof in response to a variation in an output voltage of said control winding caused by a variation in a collector voltage of said oscillation transistor thereby maintaining the collector voltage of said oscillation transistor substantially constant irrespective of variations in an input voltage applied to said oscillation circuit and a load applied to an output winding provided on the secondary side of said transformer, whereby a stabilized high-voltage for ignition is obtained from said output winding of said transformer.

2. An ignition apparatus for a burner, as claimed in claim 1, wherein said rectifying circuit comprises a rectifying diode and a smoothing capacitor whose capacitance is so chosen as to make the charging time constant small as compared with the oscillation period of said blocking oscillator circuit, and said blocking oscillator circuit is driven only by half-wave cycle of an oscillation starting voltage produced by said rectifying circuit thereby oscillating intermittently.

3. An ignition apparatus for a burner, as claimed in claim 1, wherein said high-voltage transformer comprises a multi-legged magnetic core having closed magnetic circuits; a collector winding, a base winding and a control winding stacked one upon another on one of the legs of said magnetic core; and an output winding provided on another leg of said magnetic core.

4. An ignition apparatus for a burner, as claimed in claim 3, wherein said magnetic core is a three-legged core consisting of an E-shaped and an I-shaped core members, and the middle leg of said core is used as a magnetic shunt.

5. An ignition apparatus for a burner, as claimed in claim 1, wherein said control circuit is so constructed that an ac voltage derived from said control winding is applied via a rectifying diode, a thermistor and a base resistor to a control transistor, said thermistor controlling the base current of said control transistor in response to a variation in ambient temperature, and said control transistor has its collector connected via a rectifying diode with a base resistor of said oscillation transistor of said blocking oscillator circuit, and its emitter connected with the emitter of said oscillation transistor.

6. An ignition apparatus for a burner, as claimed in claim 1, wherein said control circuit is so constructed that an ac voltage derived from said control winding is applied via a rectifying diode, a thermistor and a base resistor to a control transistor, said thermistor, controlling the base current of said control transistor in response to a variation in ambient temperature, and said control transistor has its collector connected with the base resistor of said oscillation transistor of said blocking oscillator circuit and its emitter connected with the emitter of said oscillation transistor, and a protecting diode is connected between the collector and the emitter of said control transistor, with the cathode of said protecting diode being connected with said collector of said control transistor.

7. An ignition apparatus for a burner, as claimed in claim 1, wherein said rectifying circuit is of a diode-bridge configuration for full-wave rectification.

8. An ignition apparatus for a burner comprising:

a rectifying circuit connected to an ac power source;

a blocking oscillator circuit connected to receive a rectified output from said rectifying circuit, said blocking oscillator circuit including an oscillation transistor, and a collector winding and a base winding, which are provided on a primary side of a high-voltage transformer; and, a control circuit for detecting a fluctuation of an oscillation output voltage and for controlling the oscillation output voltage to substantially a constant oscillation voltage, said control circuit including a control winding and a control transistor having a base connected to said control winding a collector-emitter circuit of said control transistor being connected to a base of said oscillation transistor, said control winding being disposed on the primary side of said high voltge transformer and being magnetically coupled with said collector winding of said blocking oscillator circuit, such that a variation in the oscillation output voltage of said collector winding due to a fluctuation in input voltage applied to said blocking circuit or a fluctuation in load connected to an output winding provided on the secondary side of said high voltage transformer is detected by said control winding and a base current of said oscillation transistor is controlled through the collector-emitter circuit of said control transistor to produce a substantially constant oscillation output, whereby a stabilized high voltage for ignition is obtained from said output winding of said transformer.

* * * * *